US007073233B2

(12) United States Patent
Leva et al.

(10) Patent No.: US 7,073,233 B2
(45) Date of Patent: Jul. 11, 2006

(54) SLIDE FASTENER

(75) Inventors: Vincent Leva, Lille (FR); Yutaka Maruyama, Lille (FR); Savine Lepretre, Lille (FR); Meirion Williams, Cheshire (GB); Gareth Jones, Cheshire (GB)

(73) Assignee: YKK Europe Limited, London (GB)

( * ) Notice: Subject to any disclaimer, the term of this patent is extended or adjusted under 35 U.S.C. 154(b) by 0 days.

(21) Appl. No.: 10/806,664

(22) Filed: Mar. 22, 2004

(65) Prior Publication Data

US 2005/0204516 A1 Sep. 22, 2005

(51) Int. Cl.
*A44B 19/30* (2006.01)

(52) U.S. Cl. ..... 24/386

(58) Field of Classification Search ..... 24/386, 24/385; 70/68

See application file for complete search history.

(56) References Cited

U.S. PATENT DOCUMENTS

| | | | | | |
|---|---|---|---|---|---|
| 2,398,947 | A | * | 4/1946 | Marinsky | 24/386 |
| 2,517,403 | A | * | 8/1950 | Morin | 24/386 |
| 2,621,387 | A | * | 12/1952 | Williams | 24/386 |
| 2,701,903 | A | | 2/1955 | Williams | |
| 4,015,457 | A | | 4/1977 | Fukuroi | 70/68 |
| 4,081,882 | A | * | 4/1978 | Toepelt et al. | 24/386 |
| 4,123,829 | A | * | 11/1978 | Takabatake | 24/386 |
| 4,395,891 | A | | 8/1983 | Remington | 70/68 |
| 4,578,966 | A | * | 4/1986 | Kasai | 70/68 |
| 4,976,120 | A | * | 12/1990 | Terada et al. | 70/68 |
| 5,031,944 | A | * | 7/1991 | Keyaki | 70/68 |
| 5,103,657 | A | * | 4/1992 | Horita et al. | 70/68 |
| 6,062,051 | A | * | 5/2000 | Nam et al. | 70/68 |
| 6,510,593 | B1 | * | 1/2003 | Kim | 24/386 |

FOREIGN PATENT DOCUMENTS

| | | |
|---|---|---|
| DE | 29916218 | 5/2000 |
| EP | 402914 A1 | 12/1990 |
| EP | 1300093 A1 | 4/2003 |
| EP | 1300094 A1 | 4/2003 |
| GB | 512989 | 10/1939 |

OTHER PUBLICATIONS

European Search Report from App. No. EP 01 40 2561 (3 pages).
European Search Report from App. No. EP 02 25 4795 (3 pages).

* cited by examiner

*Primary Examiner*—Robert J. Sandy
(74) *Attorney, Agent, or Firm*—Schwegman, Lundberg, Woessner and Kluth

(57) ABSTRACT

A slide fastener is provided which has two sliders arranged to be slidable on a pair of interlocking stringers so as to open the fastener when separated and close the fastener when brought together, at least one receiving portion disposed on one of the sliders, at least one latching member disposed on one of the sliders and engageable with the receiving portion. The sliders engage and are separated by deformation of the receiving portion and/or the latching member. The slider body portion is formed separately to the latch body portion so that different materials may be used. A two part slider having a decorative surface body portion, in place of the latch body portion, is also disclosed.

14 Claims, 6 Drawing Sheets

SLIDE FASTENER

The present invention relates to slide fasteners or sliding clasp fasteners, in particular, but not limited to slide fasteners for bags and garments.

More particularly, the invention relates to slide fasteners having two moveable sliders such that the fastener may be opened at any point along its length.

Slide fasteners of the above type are well known in general. However, there is a tendency for the sliders to separate accidentally, so opening the fastener. In order to overcome this problem, different lockable fasteners have been suggested. However, these must have mechanisms which allow the locking to take place, and these mechanisms are often very complicated, requiring many parts in each slider.

Therefore, a need for a simpler fastener which hinders accidental separation of the sliders is seen.

It is therefore an object of the present invention to remove or ameliorate at least one of the disadvantages of the prior art.

According to a first aspect of the invention there is provided a slide fastener comprising a first slider and a second slider arranged to be slidable on a pair of interlocking stringers so as to open the fastener when separated and close the fastener when brought together; a first receiving portion disposed on the first slider; a first resilient latching member disposed on the second slider and engageable with the first receiving portion; a second receiving portion disposed on one of the sliders; and a second resilient latching member disposed on the other of the sliders and engageable with the second receiving portion; wherein the first and second receiving portions are arranged to engage with the first and second latching members respectively, to releasably latch the first and second sliders together, and the latching members and receiving portions are arranged to be disengaged by lateral movement of the latching members, so unlatching the sliders.

The relative lateral movement of the latching members may be caused by movement of the sliders along the axis of the fastener. It may also be caused by manipulation of the latching members by a user.

Preferably, the first and second latching members and first and second receiving portions are arranged to be spaced laterally from the centre of the first and second sliders.

Preferably, the first and second latching members are elongate external protrusions. Also preferably, the latching members enter one or more recesses in the corresponding slider to engage the receiving portions. These features mean that the latching members are retained at least partially inside the sliders when engaged so reducing the probability of fouling of the latching members.

Preferably, the slide fastener also comprises a lead member on one of the sliders, a guide portion on the other slider, the guide portion arranged to guide the lead member when the first and second sliders are brought together, wherein the lead member and guide portion align the first and second sliders and inhibit lateral movement therebetween. An advantage of this is that the first and second sliders are aligned to allow the latching members to engage with the receiving portions. Additionally, inhibiting lateral movement between the sliders reduces the likelihood of accidental separation of the sliders.

Preferably, the lead member is located between the latching members. This arrangement allows a central lead member with the latching members engaging laterally disposed receiving portions.

According to a second aspect of the invention there is provided a slide fastener comprising a first slider and a second slider arranged to be slidable on pair of interlocking stringers so as to open the fastener when separated and close the fastener when brought together; a resilient latching member disposed on the first slider; a receiving portion disposed on the second slider and arranged to engage the latching member such that when engaged, the latching member and receiving portion inhibit separation of the first and second sliders; a lead member on one of the first and second sliders; a guide portion on the other slider, arranged to guide the lead member when the first and second sliders are brought together, wherein the lead member and guide portion align the first and second sliders and inhibit lateral movement therebetween.

Preferably, the lead member comprises an elongate external protrusion on one of the sliders. This facilitates guiding of the sliders into relative alignment when they are brought together.

Preferably, the guide portion is within one of the sliders. This allows the two sliders to be brought completely together so that there is substantially no gap between the two sliders when they are latched.

Preferably, there are two lead members. This allows more positive engagement of the guide portion.

Preferably, the opposing faces of the sliders are curved and of complimentary shape for engagement. This ensures there is no substantial gap between the sliders when they are latched.

Preferably, at least one of the sliders is formed as an integral single piece. This reduces working and manufacturing costs. The piece may be formed by die casting or injection moulding, or any other suitable method.

In a further aspect of the invention, the slide fastener comprises a first slider and a second slider arranged to be slidable on a pair of interlocking stringers so as to open the fastener when separated and close the fastener when brought together, the first slider comprising two latching members adjacent respective sides of the first slider, the arrangement being such that the two sliders clip together by the engagement of the latching members with the second slider and, when clipped together, respective outside lateral zones of the latching members are accessible so that the sliders can be unclipped by squeezing the latching members towards each other.

In particularly a preferred form of the invention, the latching member is formed as a separate part to a body of the slider. In this way different materials can be used so as to optimise the material to the function. The slider body needs to meet the requirements such as low friction and low wear, for example, whereas the latching member needs to be resilient.

Thus, another aspect of the invention provides a slider for a slide fastener, the slider having a resiliently deformable latching member for latching the slider to a co-operating slider, wherein the slider has a slider body portion which is slidable over elements of a slide fastener to engage and disengage the elements, and a latch body portion incorporating the latching member, the latch body being mounted on the slider body portion.

By forming a slider of two parts, it is possible to provide a decorative feature for attachment to a slider body. The decorative feature need not be limited to latching arrangements and can be readily changed during the production process.

Thus, another aspect of the invention provides a slider for a slide fastener, the slider having a slider body portion which is slidable over elements of a slide fastener to engage and disengage the elements, and a surface body portion mounted on an upper surface of the slider body portion.

Embodiments of the invention will now be described, by way of example, with reference to the accompanying drawings in which.

Figure 15:
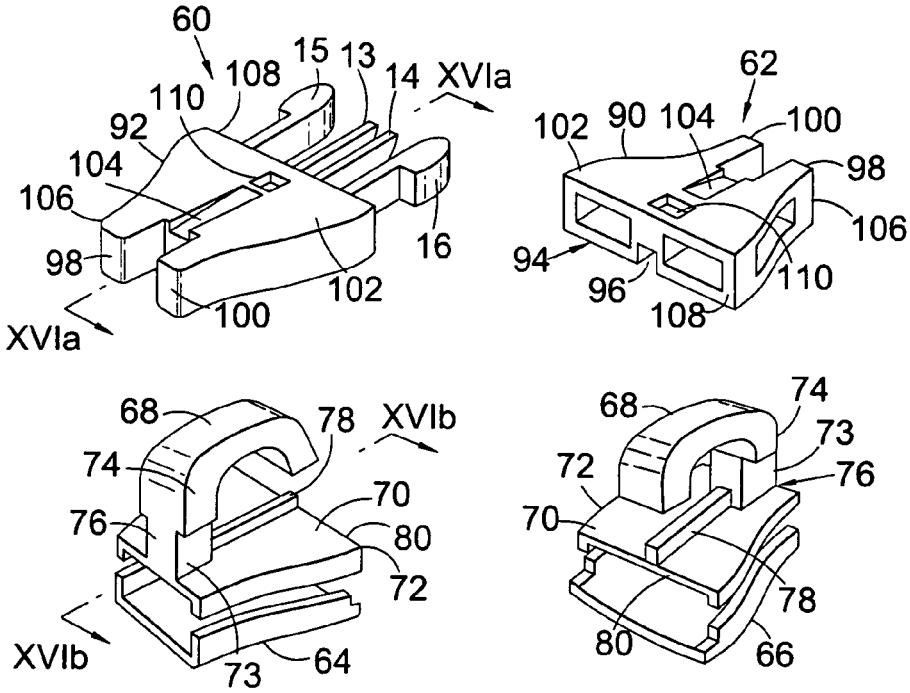
FIG. 15 shows the sliders of FIG. 14, with the parts separated.
Figures 16A, 16B:
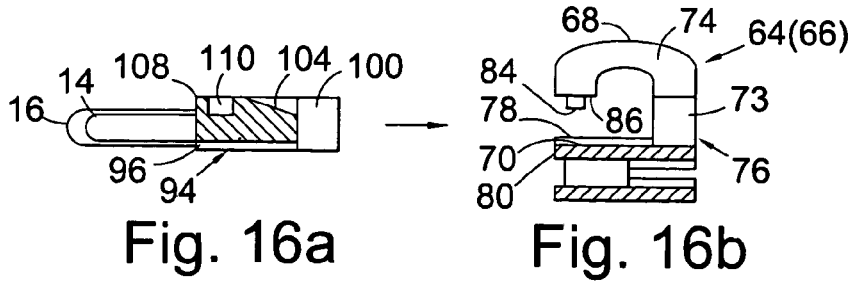
Figure 17:
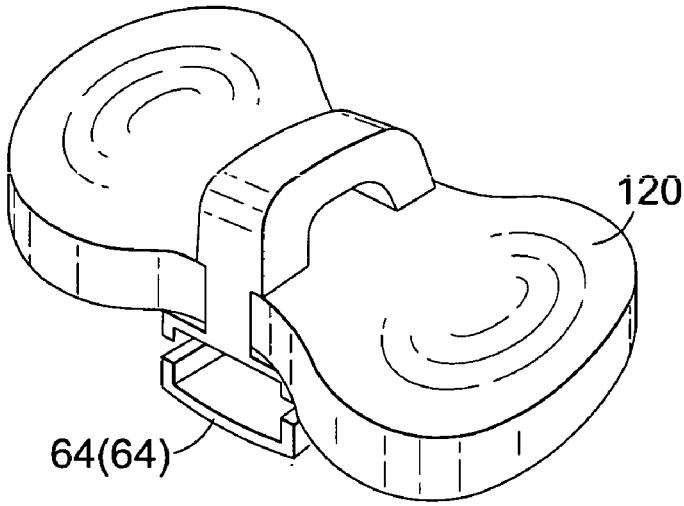

FIGS. 16*a* and 16*b* are cross-sections along lines XVIa—XVIa and XVIb—XVIb respectively of FIG. 15;

FIG. 17 shows a slide fastener with a decorative part, and

Figure 18:
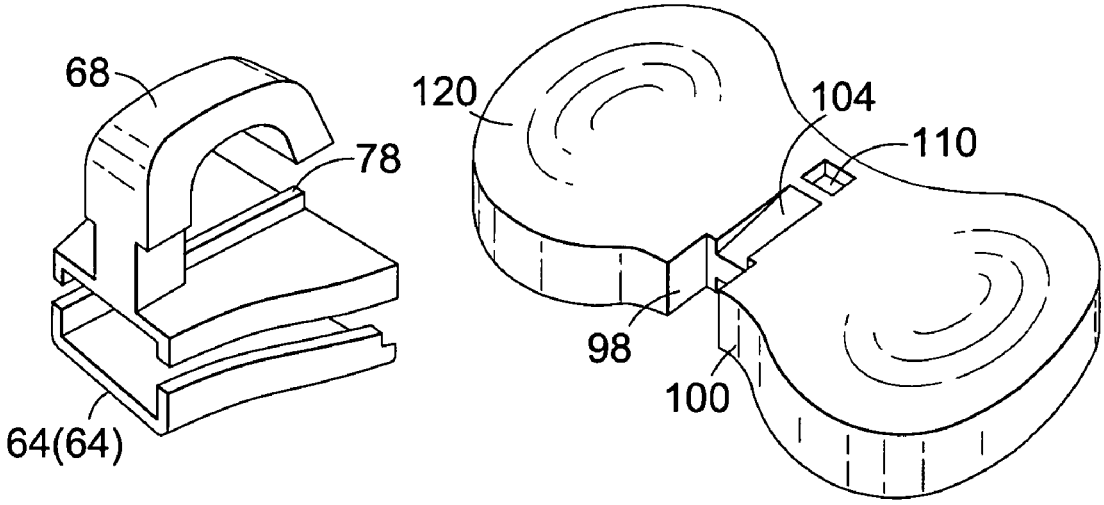

FIG. 18 shows the slide fastener of FIG. 17 with the parts separated.

Figure 19:
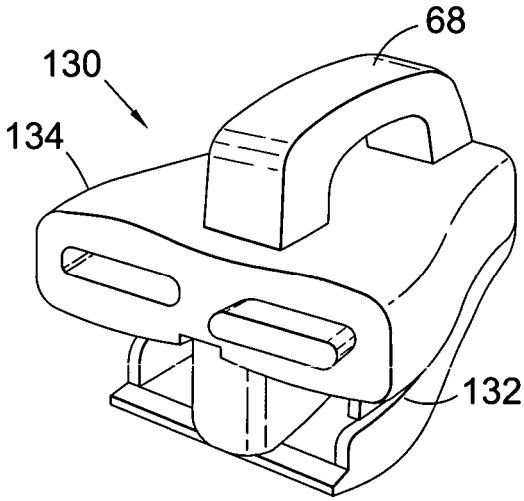

FIG. 19 is a perspective view of a slider according to a further embodiment of the invention.

Figure 20:
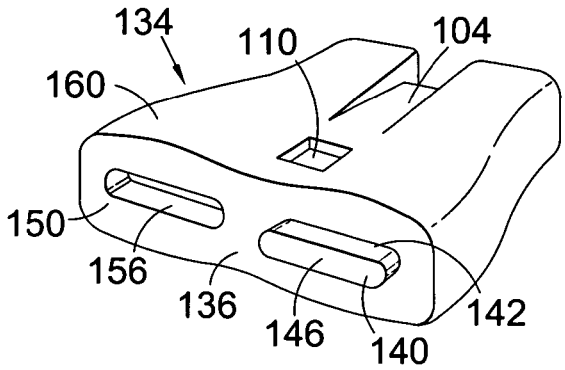

FIG. 20 is a perspective view of a latch portion of the slider of FIG. 19.

Figure 21:
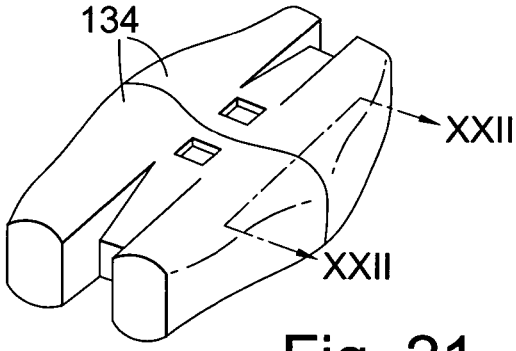

FIG. 21 is a perspective view of two abutted latch portions of FIG. 20.

Figure 22:
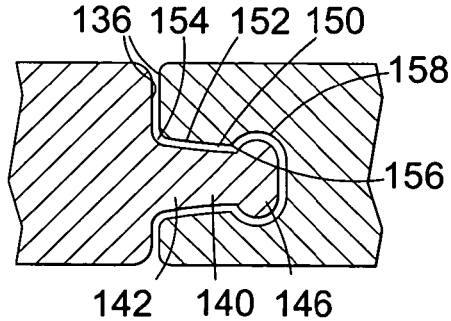

FIG. 22 is a partial section through plane XXII—XXII shown in FIG. 21.

Figure 1:
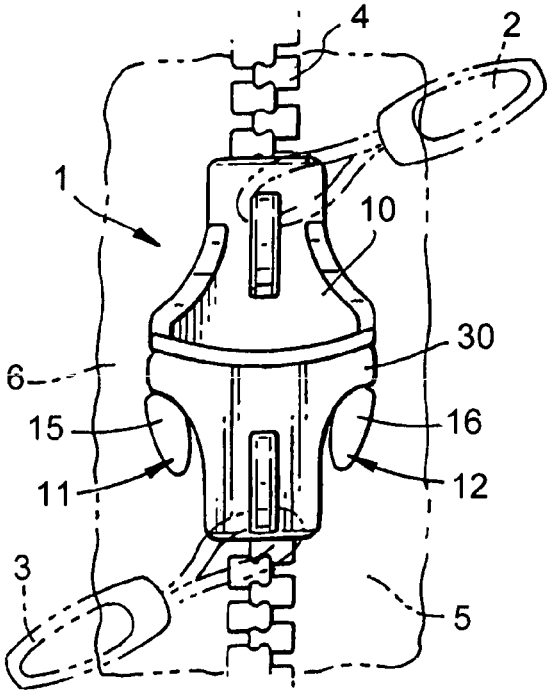
FIG. 1 is a top view of a slide fastener in accordance with the invention, with two sliders engaged on two stringers.

FIG. 1 shows a slide fastener 1 comprising a first slider 10, a second slider 30 and a zip 4. A zip denotes a fastening mechanism having stringers which interlock by means of teeth. The teeth are shown here as discrete elements. As well known in the art, they may be insert moulded onto a tape, or metal elements clamped to the tape, or formed by continuous helically wound fibre sewn or woven into the tape. Also, the sliders may be used with fastener types with continuously engaged edges.

The zip 4 comprises first and second toothed stringers 5, 6, which are joined and separated by the first and second sliders 10, 30. Additionally, two pullers 2, 3 are provided in the form of profiled knobs, one on each of the sliders, to pull the sliders along the zip 4. The sliders 10, 30 each have a front end which contacts with the other slider, and a rear end which is opposite to the front end.

Figure 2:
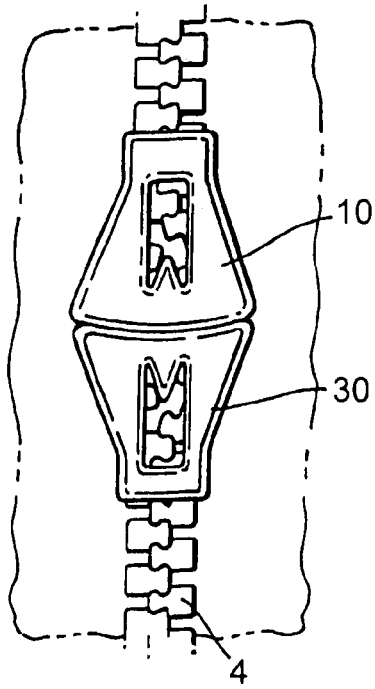
FIG. 2 is an underneath view of the slide fastener with the sliders engaged.

FIG. 2 shows the underside view of the slide fastener 1, which again shows the first and second sliders 10, 30 and the zip 4. The sides shown in FIG. 1 will generally be placed on the outside of the bag, garment or other article to which the slide fastener 1 would be attached and the side shown in FIG. 2 would be on the inside.

Figure 3:
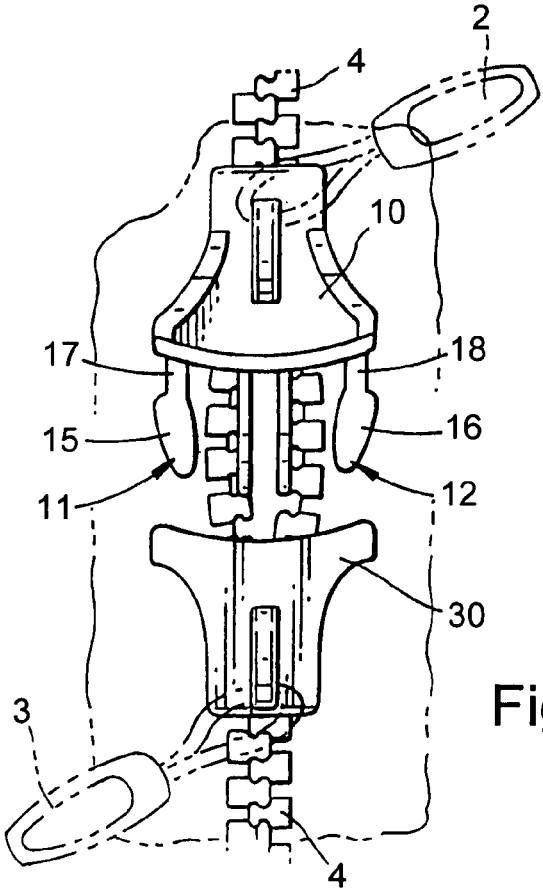
FIG. 3 is a top view of the slide fastener with the sliders disengaged.

FIG. 3 shows the slide fastener 1 with the first and second sliders 10, 30 in a non engaged position. In the region between the two sliders, the first and second stringers 5, 6 are separated; in the region outside the sliders 10, 30 the two stringers 5, 6 are interlocked to close the fastener 1.

The first and second sliders 10, 30 have a standard arrangement for separating and joining the interlocking stringers 5, 6. A divider 25, 45 connects a base 28, 48 to the main body of the slider 10, 30 and this base has a lower retaining flange 27, 47 on the lateral edges of the base 28, 48, which points towards the main body. The base 28, 48 widens laterally from the outer end of the slider 10, 30 to the engaging end. An upper retaining flange 26, 46 is situated on the main body of each slider 10, 30 and follows the same contours in the plane of the zip 4 as the lower retaining flange 27, 47. The flanges 26, 27, 46, 47 urge the teeth together as the slider is moved in the forward direction and the divider 25, 45 acts to separate the teeth as the sliders move apart.

The interlocking mechanism of the sliders 10, 30 is independent of the base 28, 48 and divider elements 25, 45, which act to separate and join the teeth of the stringers 5, 6 of the zip 4.

Figure 4:
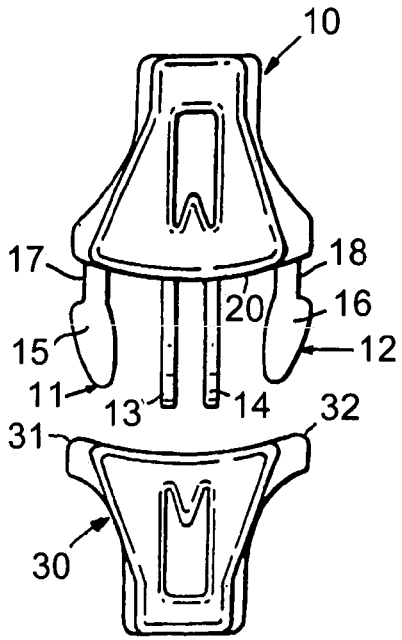
FIG. 4 is an underside view of the sliders detached from the stringers.
Figure 5:
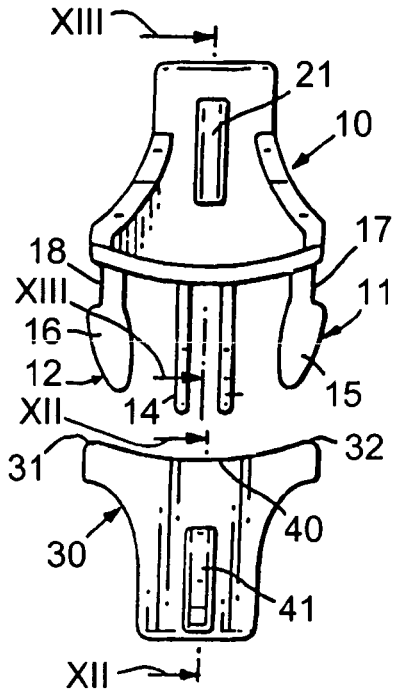
FIG. 5 is a top plan view of the sliders detached from the stringers.
Figure 6:
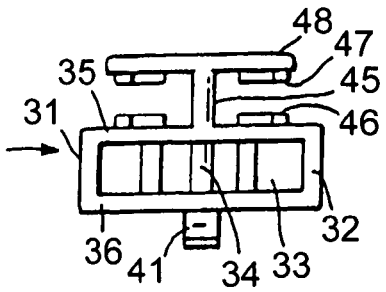
FIG. 6 is an end view of one of the sliders.
Figure 7:
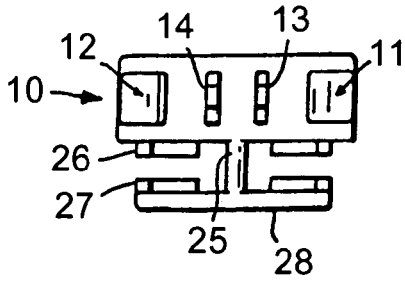
FIG. 7 is an end view of the other slider.
Figure 8:
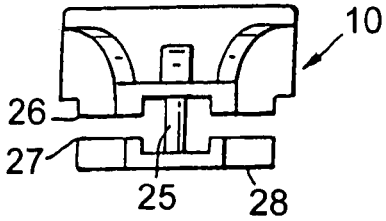
FIG. 8 is a rear end view of one of the sliders.
Figure 9:
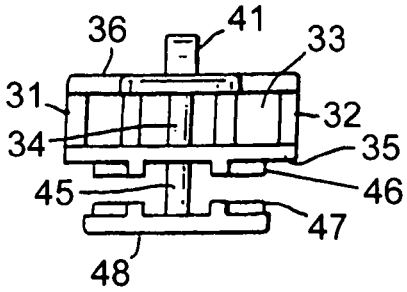
FIG. 9 is a rear view of the other slider.
Figure 10:
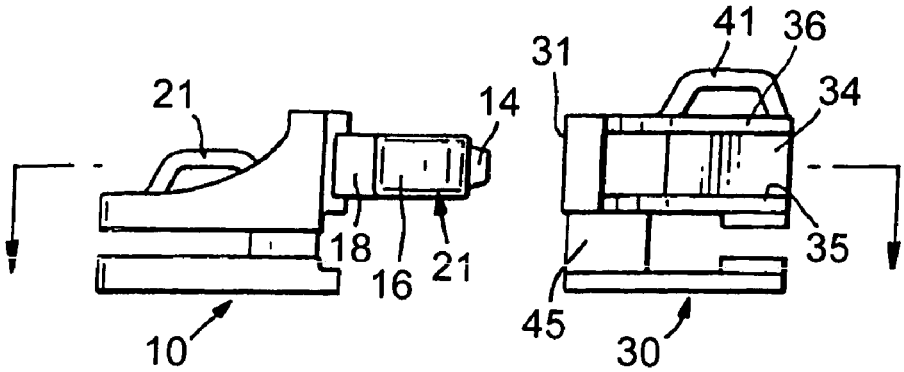
FIG. 10 is a side view of the sliders.

FIGS. 4 and 5 show the first and second sliders 10, 30 removed from the zip 4 and separated. First and second latching members, which in this embodiment are arms 11 and 12, and first and second lead members 13, 14 are arranged on the first slider 10. The first and second arms 11, 12 and the first and second lead members 13, 14 protrude from a curved abutting surface 20 on the engaging end of the first slider 10.

Each arm 11, 12 has a neck portion 17, 18 adjacent the abutting surface 20 and a head portion 15, 16 distal to the abutting surface 20. The neck portions 17, 18 are resiliently deformable. The whole arm 11, 12 is made from the same material, so that the whole arm 11, 12 is resiliently deformable but the decreased width of the arm at the neck 17, 18 has the effect that most of the deformation occurs in the neck 17, 18. Alternatively, the head 15, 16 and neck 17, 18 portions could be made of different materials. For example, the head 15, 16 could be made to be resiliently flattenable laterally and the neck 17, 18 kept rigid, which would achieve the same effect.

Arranged on the top of the first slider 10 is a loop or crown 21 for attaching the puller 2.

The second slider 30 also has a loop or crown 41 for attaching puller 3. The second slider 30 has an abutting surface 40 on the engaging end which is complimentary in shape to the abutting surface 20 of the first slider 10.

Figure 11:
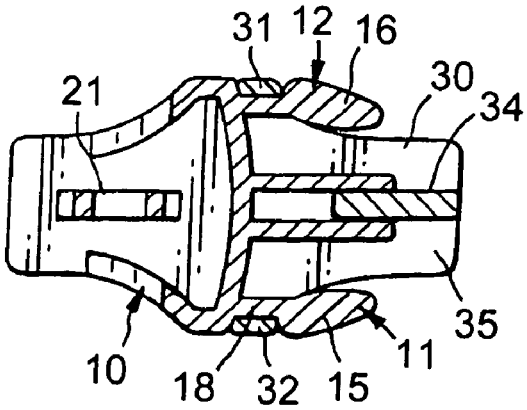
FIG. 11 is a section through plane XI—XI shown in FIG. 10, but showing both sliders clipped together.
Figure 12:
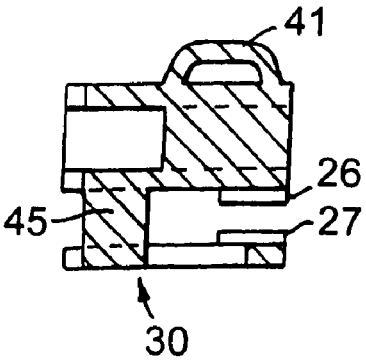
FIG. 12 is a section through plane XII—XII shown in FIG. 5, through the female slider.
Figure 13:
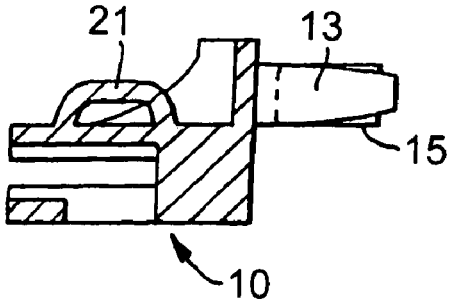
FIG. 13 is a section through plane XIII—XIII shown in FIG. 5, through the male slider.

As can be seen from FIG. 11, the second slider 30 has first and second receiving portions 31, 32 which are disposed laterally on the second slider 30. The receiving portions 31, 32 are rigid and substantially non-deformable, and form vertical members that support the top of the second slider 30; the loop 41 is mounted on the top 36 of the slider 30.

The second slider 30 has a central cross-piece 35, which is parallel to the top 36. The receiving portions 31, 32, together with the top 36 and central cross-piece 35 define a hole or recess 33. This can also be seen from FIG. 11.

FIG. 11 shows a section through the sliders 10, 30 while they are engaged. The arms 11, 12 are engaged with the receiving portions 31, 32. FIG. 11 also shows a guide member 34 on the second slider 30. The guide member 34 is arranged centrally, and extends rearwardly, towards the outside end of the slider 30 from a position set back from the hole 33. The amount that the guide portion 34 is set back from the entrance to the hole 33 is not critical, as long as the lead members 13, 14 engage it when the sliders 10, 30 are brought together. Preferably, the lead members 13, 14 engage the guide portion 34 while the arms 11, 12 are still separated from the receiving portions 31, 32. This allows the sliders 10, 30 to be aligned and reduces the possibility of only one of the arms 11, 12 passing into the hole 33, causing fouling of the sliders 10, 30.

The guide portion 34 is elongate, and extends between the top 36 and the centre cross-piece 35. The lead members 13, 14 engage the guide portion 34 laterally, with one lead member extending on either side of the guide portion 34. Alternatively, the guide portion 34 could comprise a central slot, with which a single lead member could cooperate to achieve the same result.

The guide portion 34 and lead members 13, 14 resist relative lateral movement of the sliders 10, 30, which helps to prevent accidental release of the arms 11, 12 from the receiving portions 31, 32. The elongate nature of the lead members 13, 14 and guide portion 34 also inhibits relative rotational movement of the sliders 10, 30.

As can be seen from FIG. 11, in order to engage the second slider 30 from the non engaged position, the arms 11, 12 must deform inwardly, to allow the heads 15, 16 of the arms 11, 12 to enter the hole 33 and positively engage with the receiving portions 31, 32. As stated above, the arms 11, 12 may deform in several ways in order to accomplish this. The important requirement is that the arms 11, 12 deform when they come into contact with the receiving portions 31, 32 so that they can pass into the hole 33 and then resume their default shape to engage the receiving portions 31, 32.

The arms 11, 12 deform and enter the hole 33 in the second slider 30. The dimensions of the neck 17, 18 and receiving portions 31, 32 is such that the depth of the receiving portions 31, 32 is slightly less than the length of the neck 17, 18. In addition, the lateral spacing of arms 17, 18, heads 15, 16 and receiving portions 31, 32 is such that the heads 15, 16 extend laterally outward of the internal surface of the receiving portion 31, 32, and the lateral distance from the centre of the slider of the outside surface of the neck 17, 18 is slightly less than that of the internal surface of the receiving portion 31, 32. In this way, the heads 15, 16 pass the receiving portions 31, 32 and return to their undeformed configuration substantially as the abutting surfaces 20, 40 of the engaging ends abut. The tolerances of these dimensions are important, in that the necks 17, 18 must be sufficiently longer than the receiving portions 31, 32 to allow the arms 11, 12 to return to their undeformed configuration.

Alternatively, the arms 11, 12 could be rigid, and the receiving portions could be resiliently deformable inwardly. The hole 33 is partially maintained in shape using guide portion 34 to act as a strut.

The tail portion of the heads 15, 16, i.e. that nearest the neck 17, 18, is squared. Alternatively, the tail portion may be tapered or sloped from head 15, 16 to neck 17, 18. In the latter cases, the engagement with the receiving portion 31, 32 is not so positive, and the resistance to separation of the sliders 10, 30 is lower. In addition, the amount that the head 15, 16 extends laterally beyond the neck 17, 18 can be varied to vary the resistance to separation of the sliders 10, 30. The greater the overhang, the more secure the engagement. The width of the arm head 15, 16 cannot be larger than the lateral distance between the outside of the lead member 13, 14 and the inside of the receiving portion 31, 32, or the arm head 15, 16 will abut the lead member 13, 14 without deforming sufficiently to allow the arm 11, 12 to pass into the hole 33 and engage with the receiving portion 31, 32.

In order to release the sliders 10, 30 from engagement, the arms 11, 12, must be deformed at substantially the same time. If only one arm 11 is deformed inwardly, then the lateral movement will not be transferred to the second arm 12 due to the inhibition of lateral and rotational movement of the lead members 13, 14 relative to the guide portion 34. Therefore, both arms 11, 12 must be deformed inwardly at substantially the same time in order for the arms 11, 12 to be disengaged and the sliders 10, 30 separated. Such lateral movement can be achieved by squeezing the heads 15, 16 of the arms 11, 12 with finger and thumb, and separating the sliders 10, 30.

If the tail portions of the heads 15, 16 are sufficiently inclined, then such pinching of the heads 15, 16 is not required, and simply pulling the two sliders 10, 30 apart with sufficient force will separate them. The sliders 10, 30 will still resist accidental separation, but will separate in response to a strong longitudinal force.

Alternatively, the tail of the head portion 15, 16 and the part of the receiving portion 31, 32 adjacent to it could have complimentary engaging formations on them, such as a ridge and groove (not shown). These would then act as further resistance to separation, as the ridge and groove would interlock and resist inward deformation of the head portions 15, 16. Extra force would then be required to deform the arms 11, 12 and separate the sliders 10, 30, which would further lower the possibility of accidental separation, while ensuring that engaging the sliders 10, 30 did not require undue effort as the resilience of the arms 11, 12 would not be affected. Preferably, the neck would be longer than the depth of the receiving portion in this case, so that the heads 15, 16 could return to their non-deformed configuration without interference from the complimentary engaging formations. Then, when the sliders 10, 30 were pulled apart, the complimentary engaging formations would interlink.

The sliders 10, 30 may be formed in a single piece. The forming may be achieved by diecasting, in which case, the material used will be suitable for diecasting—e.g. iron, steel, or tin. Any other suitable material could also be used. Alternatively, the forming may be achieved by injection moulding using a suitable plastics material. Any other suitable method of forming would be also appropriate.

By forming the slider 10, 30 of two separate parts it is possible to achieve several advantages. The shape of the separate parts is less complex, different materials may be used to suit the different functions of the parts, and a range of colour combinations may also be provided.

Figure 14:
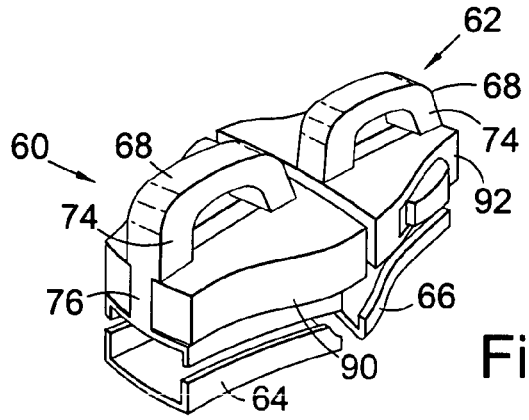
FIG. 14 is a perspective view of two sliders having a latching mechanism similar to that of FIG. 1, and formed of separate parts.

FIG. 14 shows a pair of sliders having a latching arrangement similar to that of FIGS. 1 to 13, but with each slider formed of separate parts. Each slider 60, 62 has a slider body 64, 66. The bodies 64, 66 are of identical construction and may be integrally moulded of plastics material or die cast of metal for example. Referring to FIG. 15, the bodies 64, 66 have a crown 68 which projects from the upper surface 70 of the upper wing 72 of the slider body 64, 66. The crown has a recess 73 in each side wall 74 at the base region 76 adjacent surface 70. A guide rail 78 extends from the base region 76 at the rear end of the crown to the opposite edge 80 at the front of the slider wing 72.

Referring to FIG. 16*b*, the front end 82 of the crown 68 has a projection 84 on its underside 86.

Referring back to FIG. 14, the sliders 60, 62 have respective latch body portions 90, 92. These may be in male and female forms, as seen in the embodiment of FIGS. 1 to 13. The latch body portions 90, 92 overhang the slider body portions 60, 62 at the sides. The male latch body portion 90 is shown in FIG. 16. The underside 94 has a groove 96 which is dimensioned to receive the guide rail 78 when the latch body portion 90 is slid onto the slider body portion 60, 62 as will be described hereinafter. At the rear end 106 the latch body is bifurcated, to provide two legs 98, 100 which will straddle the crown 68 at base region 76, sitting in the recesses 73 and engaging the upper edge of the recess 73 so that the latch body member 90, 92 is held against the surface 70 of the slider body 60, 62. Recessed into the upper surface 102 of the latch body member 90, 92 is a ramp 104 which leads from the rear end 106 between the legs 98, 100 towards the front end 108. The ramp 104 leads up to the surface 102 and ends in a recess 110 which receives the projection 84 of the crown 68.

To assemble the latch body portion 90, 92 onto a slider body portion 64, 66, the legs 98, 100 slide either side of the projection 84 until the projection engages the ramp 104, and the guide rail 88 engages groove 96. The ramp 104 causes the end 82 of crown 68 to flex upwardly until the slider body 64, 66 is slid fully home, legs 98, 100 being received in recesses 73 and the underside 86 of the crown 68 bearing on the upper surface 102 with projection 84 received in recess 110 to hold the latch body in place. Therefore, the latch body portion 90, 92 is connected to the slider body portion 64, 66 by a form locking connection.

In place of ramp 104 for resiliently deforming crown 68 during assembly, crown 68 could be deformed or pinched over after the latch body is in place to trap the latch body member, particularly when the slider body is of metal.

Other attachment arrangements could be used. However it is particularly preferred to form the crown 68 as an integral part of the slider body portion 64, 66, the force of the puller, attached to the crown 68, is then transmitted directly to the slider body portion 64, 66 instead of via the latch body member 90, 92.

The mounting and fixing arrangement for the female member 92 on slider body 64, 66 is the same.

It can be seen that it is possible to use a common slider body portion 64, 66. The latch body portion 90, 92 may be added after the slider is mounted on a stringer, and even after the zip fastener is sewn to a bag, garment etc. Also, if a part breaks during sewing, it can be easily replaced without replacing the complete slider. The female latch body portion 90, in the particular latch mechanism described, may be formed integrally with the slider body. Similarly the puller can be replaced by temporarily removing the latch body portion 90, 92.

Referring to FIGS. 17 and 18, in place of a latch body 90, 92, a decorative part 120 may be used in place of the latch body portion 90, 92. The slider body can be used on its own or in combination with another slider. The decorative shape could also be used with a latch mechanism.

FIG. 19 is a perspective view of a slider according to a further embodiment of the invention, having an alternative latching arrangement. The slider 130 is comprised of a slider body portion 132 and a latch body portion 134. The structure of the slider body portion 132 is the same as the structure of the slider body portion 64, 66 shown in FIGS. 14 to 18, i.e. the same slider body portion 132 can be used for each of two slider fasteners which form a pair. The latch body portion 134 is fitted to the slider body portion 132 in the same manner as the latch body portions 90, 92 are fitted to the slider body portions 64, 66 in FIGS. 14 and 15.

FIG. 20 is a perspective view of the latch body portion 134 of the slider 130 of FIG. 19. The abutting surface 136 of the latch body portion 134 is laterally divided into a portion bearing a protrusion 140 and a portion bearing a tapered mouth 150. The protrusion 140 has a mushroom shaped cross section, being comprised of a neck portion 142 adjacent to the abutting surface 136 and a head portion 146 distal to the abutting surface 136.

The tapered mouth 150 has a mushroom shaped cross section which can accommodate the protrusion 140. It is comprised of a neck portion 152 which narrows from it its opening 154 to form a ridge 156 with a cross section smaller than the cross section of the widest point of the head 146 of the protrusion. Beyond the ridge 156, the tapered mouth 150 widens to form a head 158. FIG. 21 is a perspective view of two abutted latch body portions 134 of FIG. 20 and FIG. 22 is a partial section through plane XXII—XXII shown in FIG. 21, showing the shape of the cross section through a protrusion 140 and tapered mouth 150. The upper surface 160 of the latch body portion 134 contains a ramp 104 and a recess 110 which receives the projection of the crown 68 of the slider body portion 134, similar to the previous embodiment.

Referring to FIG. 21, it can be seen that two identical latch body portions 134 can be latched together. This has the advantage that a small number of parts is required to make up a pair of mating sliders.

A force must be applied to engage two sliders 130, in order to push the head 146 of the protrusion 140 of each latch body portion 134 beyond the ridge 156 of the corresponding tapered mouth 150 in the abutting surface 136 of the other latch body portion 134. The force required depends on the geometry of the protrusion 140 and the tapered mouth 150 and the material from which they are made. The arrangement provides a snap fit connection between the latch body portions 134. Preferably a force of between 15 and 25N is required to pull the latch body portions 134 apart. Further preferably a force of between 18N and 22N is required to pull the latch body portions 134 apart. Further preferably a force of 20N is required to pull the latch body portions 134 apart.

Although the above embodiments of the slide fastener relate to a zip fastener embodiment, it will apply equally to any other type of slide fastener and it should be appreciated that further modifications and variations will suggest themselves to those versed in the art upon making reference to the foregoing description, which is given by way of example only and which is not intended to limit the scope of the invention.

The present invention has been described above purely by way of example, and modifications can be made within the spirit of the invention.

The invention claimed is:

1. A slider for a slide fastener, the slider comprising:

a member for latching the slider to a co-operating slider, a slider body portion which is slidable over elements of a slide fastener to engage and disengage the elements, and a latch body portion integrally formed with the latching member, the latch body portion being removably mounted on the slider body portion, wherein the slider body portion has a crown for receiving a puller, the crown being mounted at one end on a surface of the slider body portion, and the latch body portion co-operating with the crown to hold the latch body portion on the slider body portion, wherein the latch body portion engages with the crown at the said one end, wherein the other end of the crown is spaced from the surface of the slider body portion, and the latch body portion is sandwiched between the other end of the crown and the surface of the latch body portion.

2. A slider as claimed in claim 1, wherein the latch body portion includes a resilient latching member which is resiliently deformed on engagement and disengagement with the co-operating slider.

3. A slider as claimed in claim 1, wherein said latch body portion is connected to the slider body portion by a form locking connection.

4. A slider as claimed in claim 1, wherein the other end of the crown engages in a recess in the latch body portion.

5. A slider as claimed in claim 1, wherein the slider body portion is integrally formed.

6. In combination, a slider and a co-operating slider, the slider comprising:

a member for latching the slider to a co-operating slider, a slider body portion which is slidable over elements of a slide fastener to engage and disengage the elements, and a latch body portion integrally formed with the latching member, the latch body portion being removably mounted on the slider body portion, wherein the slider body portion has a crown for receiving a puller, the crown being mounted at one end on a surface of the slider body portion, and the latch body portion co-operating with the crown to hold the latch body portion on the slider body portion, wherein the latch body portion engages with the crown at the said one end, wherein the other end of the crown is spaced from the surface of the slider body portion, and the latch body portion is sandwiched between the other end of the crown and the surface of the latch body portion; and the co-operating slider having a slide body portion and a separately formed slide latch body portion for co-operating with the latch body portion.

7. A slide fastener comprising:

a first slider and a second slider arranged to be slidable on a pair of interlocking stringers so as to open the fastener when separated and close the fastener when brought together;

a first receiving portion disposed on the first slider;

a first resilient latching member disposed on the second slider and engageable with the first receiving portion;

a second receiving portion disposed on one of the sliders; and a second resilient latching member disposed on the other of the sliders and engageable with the second receiving portion;

wherein the first and second receiving portions are arranged to engage with the first and second latching members respectively, to releasably latch the first and second sliders together, and the latching members and receiving portions are arranged to be disengaged by lateral movement of the latching members, to unlatch the first and second sliders; and wherein one of the first or second sliders comprises a slider body portion slidable on the stringers and a latch body portion integrally formed with the first or second latching member, the latch body portion being formed separately from and removably attached to the slider body portion.

8. A slide fastener according to claim 7, further comprising:

a lead member on one of sliders;

a guide portion on the other slider, the guide portion arranged to guide the lead member when the first and second sliders are brought together, wherein the lead member and guide portion align the first and second sliders and inhibit lateral movement therebetween.

9. A slide fastener according to claim 7, wherein at least one of the sliders is formed as an integral single piece.

10. A slider for a slide fastener, the slider having a slider body portion which is slidable over elements of a slide fastener to engage and disengage the elements, and a surface body portion mounted on an upper surface of the slider body portion, the slider body portion having a crown for receiving a puller, the crown being mounted at one end on a surface of the slider body portion, and the surface body portion co-operates with the crown to hold the surface body portion on the slider body portion, the surface body portion being adapted to grip the crown at the one end, the other end of the crown being spaced from the surface of the slider body portion, the surface body portion being sandwiched between the other end of the crown and the surface of the surface body portion, and the other end of the crown engages in a recess in the surface body portion.

11. The slider of claim 10, wherein the surface body portion is removably mounted on an upper surface of the slider body portion.

12. The slider of claim 11, wherein the surface body portion is decorative.

13. A slider for a slide fastener, comprising:

a slider member for latching to a co-operating slider, a slider body portion which is slidable over elements of a slide fastener to engage and disengage the elements, a latch body portion incorporating the latching member, the latch body portion being mounted on the slider body portion, the latch body portion including a resilient latching member which is resiliently deformed on engagement and disengagement with the co-operating slider, wherein the slider body portion has a crown for receiving a puller, the crown being mounted at one end on a surface of the slider body portion, and the latch body portion co-operating with the crown to hold the latch body portion on the slider body portion, wherein the latch body portion engages with the crown at the said one end, wherein the other end of the crown is spaced from the surface of the slider body portion, and the latch body portion being sandwiched between the other end of the crown and the surface of the latch body portion, and wherein the other end of the crown engages in a recess in the latch body portion.

14. The slider of claim 13, wherein the latch body portion is integrally formed with the latching member, the latch body portion being removably mounted on the slider body portion.

* * * * *